US009010531B2

(12) United States Patent
Lowry et al.

(10) Patent No.: US 9,010,531 B2
(45) Date of Patent: Apr. 21, 2015

(54) BULK BAG CARRIER WITH PALLET

(71) Applicant: Sonoco Development, Inc., Hartsville, SC (US)

(72) Inventors: James Lowry, Franklin, TN (US); Gary Nattrass, Alpharetta, GA (US); Ronald Allen Lanier, Jr., Florence, SC (US); Matthew Marrow, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 14/043,285

(22) Filed: Oct. 1, 2013

(65) Prior Publication Data

US 2014/0126844 A1 May 8, 2014

Related U.S. Application Data

(60) Provisional application No. 61/708,093, filed on Oct. 1, 2012.

(51) Int. Cl.

| | |
|---|---|
| ***B65D 19/00*** | (2006.01) |
| ***B65D 90/00*** | (2006.01) |
| ***B65D 88/16*** | (2006.01) |

(52) U.S. Cl.

CPC ..... *B65D 90/0033* (2013.01); *Y10T 29/49826* (2015.01); *B65D 19/0012* (2013.01); *B65D 19/0059* (2013.01); *B65D 88/1625* (2013.01); *B65D 88/1668* (2013.01); *B65D 88/1687* (2013.01); *B65D 2519/00089* (2013.01); *B65D 2519/00273* (2013.01); *B65D 2519/00288* (2013.01); *B65D 2519/00293* (2013.01); *B65D 2519/00318* (2013.01); *B65D 2519/00343* (2013.01); *B65D 2519/00805* (2013.01); *B65D 2519/0087* (2013.01)

(58) Field of Classification Search

CPC ..... B65D 19/00; B65D 19/12; B65D 19/16; B65D 2519/00407; B65D 2519/0087

USPC ..... 206/586, 386, 599, 600; 108/56.3

See application file for complete search history.

(56) References Cited

U.S. PATENT DOCUMENTS

| | | | | |
|---|---|---|---|---|
| 3,026,078 | A | 3/1962 | Simkins | |
| 3,398,703 | A * | 8/1968 | Mezzano | 108/51.3 |
| RE32,308 | E | 12/1986 | Nattrass | |
| 5,143,283 | A | 9/1992 | Lancaster | |
| 5,785,175 | A | 7/1998 | Cholsaipant | |
| 6,357,587 | B1 * | 3/2002 | Melms, Jr. | 206/326 |
| 6,467,625 | B2 | 10/2002 | Baker | |
| 6,533,121 | B1 * | 3/2003 | Ross | 206/599 |
| 6,935,500 | B1 | 8/2005 | Schnaars | |
| 7,757,851 | B2 | 7/2010 | Schnaars | |
| 2004/0159565 | A1 * | 8/2004 | Von Merveldt | 206/386 |

FOREIGN PATENT DOCUMENTS

| | | | |
|---|---|---|---|
| WO | 2004096661 | A1 | 11/2004 |
| WO | 2010151367 | A1 | 12/2010 |

* cited by examiner

*Primary Examiner* — Anthony Stashick
*Assistant Examiner* — Raven Collins
(74) *Attorney, Agent, or Firm* — Miller, Matthias & Hull LLP

(57) ABSTRACT

A bulk bag carrier for transporting soft goods or granular products is provided. The carrier comprises a flexible bulk bag and a pallet. The bulk bag comprises an upper section that defines a product compartment and a sleeve suspended below the upper section that defines a pocket for receiving the pallet. The pallet may be foldable to facilitate insertion of the pallet into the sleeve.

16 Claims, 8 Drawing Sheets

BULK BAG CARRIER WITH PALLET

BACKGROUND

1. Field of the Invention

This patent relates to a carrier for transporting palletized products. More particularly, this patent relates to a carrier for transporting palletized products comprising a bulk bag and a pallet and in which the pallet is secured within a pocket integrally formed in the bulk bag.

2. Description of the Related Art

Soft goods are sometimes transported in bulk bags resting on pallets. If the bulk bags are not secured to the pallets in some way the bags have a tendency to slide or roll off the pallets, especially when the palletized unit is being carried on a forklift truck and the truck turns a corner.

Bulk bags are also used for the transport of powders and granular items such as coffee, plastic pellets, etc. The bulk bags may be equipped with a dispensing system incorporated into the bottom of the bag. However, in order to dispense from the bottom of the bag most users must hold the bag in the air by loops located at the top corners of the bag. While this dispensing method works, it requires different equipment than normal handling systems, (e.g. fork trucks) and requires a secondary apparatus for unloading the contents of the bag.

The present invention is designed to solve the problems described above.

SUMMARY OF THE INVENTION

The present invention is a flexible bulk bag carrier for shipping soft goods. The bulk bag comprises an upper section and a sleeve suspended below the upper section. The upper section defines a product compartment for holding products and comprises a bottom wall having first and second opposing side edges which form part of a periphery, a front wall, two opposing side walls and a rear wall. The front, side and rear walls extend upwardly from the periphery of the bottom wall. The downwardly hanging sleeve defines a built in pocket for receiving a pallet. The sleeve comprises a substantially rectangular section of flexible material depending downward from the upper section. The sleeve has a free front edge, a free rear edge, and two side edges. One side edge of the sleeve is substantially coextensive with and attached to the first side edge of the bottom wall. The other side edge of the sleeve is substantially coextensive with and attached to the second side edge of the bottom wall. The length of the sleeve front and rear edges (and thus the width of the sleeve) is just slightly greater than the width of the pallet plus twice the height of the pallet so that the pallet fits snugly within the sleeve.

In another aspect, the invention provides a method of assembling a carrier. The method comprises the following steps: providing a carrier having an upper section that defines a product compartment and a downwardly hanging sleeve that defines a built in pocket for receiving a pallet; folding a foldable pallet into a V-shape; sliding the V-shaped pallet into the pocket; and pushing down on the V-shaped pallet so that it assumes a flat configuration occupying essentially all the space within the sleeve.

In still another aspect, the invention is flexible bulk bag carrier for shipping granular products. The carrier comprises an upper section defining a product compartment for holding granular products and a sleeve for holding a pallet. The upper section comprises a bottom wall having first and second opposing side edges which form part of a periphery, a front wall, two opposing side walls and a rear wall. The front, side and rear walls extend upwardly from the periphery of the bottom wall. The sleeve defines a built in pocket for receiving a pallet. The sleeve comprises a substantially rectangular section of flexible material depending downward from the upper section. The sleeve has a free front edge, a free rear edge and two side edges. One side edge is substantially coextensive with and attached to the first side edge of the bottom wall. The other side edge is substantially coextensive with and attached to the second side edge of the bottom wall. To help dispense the granular product, the bottom wall has an opening that is vertically aligned with and similar in size and shape to an opening in the pallet. The carrier may further comprise a bottom chute covering the opening in the pallet and being an integral part of the bulk bag.

THE DRAWINGS FIG. 1 is an exploded perspective view of a bulk bag carrier according to the present disclosure.

FIGS. 2*a* and 2*b* are close up perspective views of a portion of the bulk bag carrier of FIG. 1 shown without and with a pallet.

FIGS. 3*a* and 3*b* are front views of one type of pallet that may be used with the present invention shown folded and unfolded.

FIGS. 4*a* to 4*h* show sample steps involved in assembling a bulk bag carrier.

Figure 1:
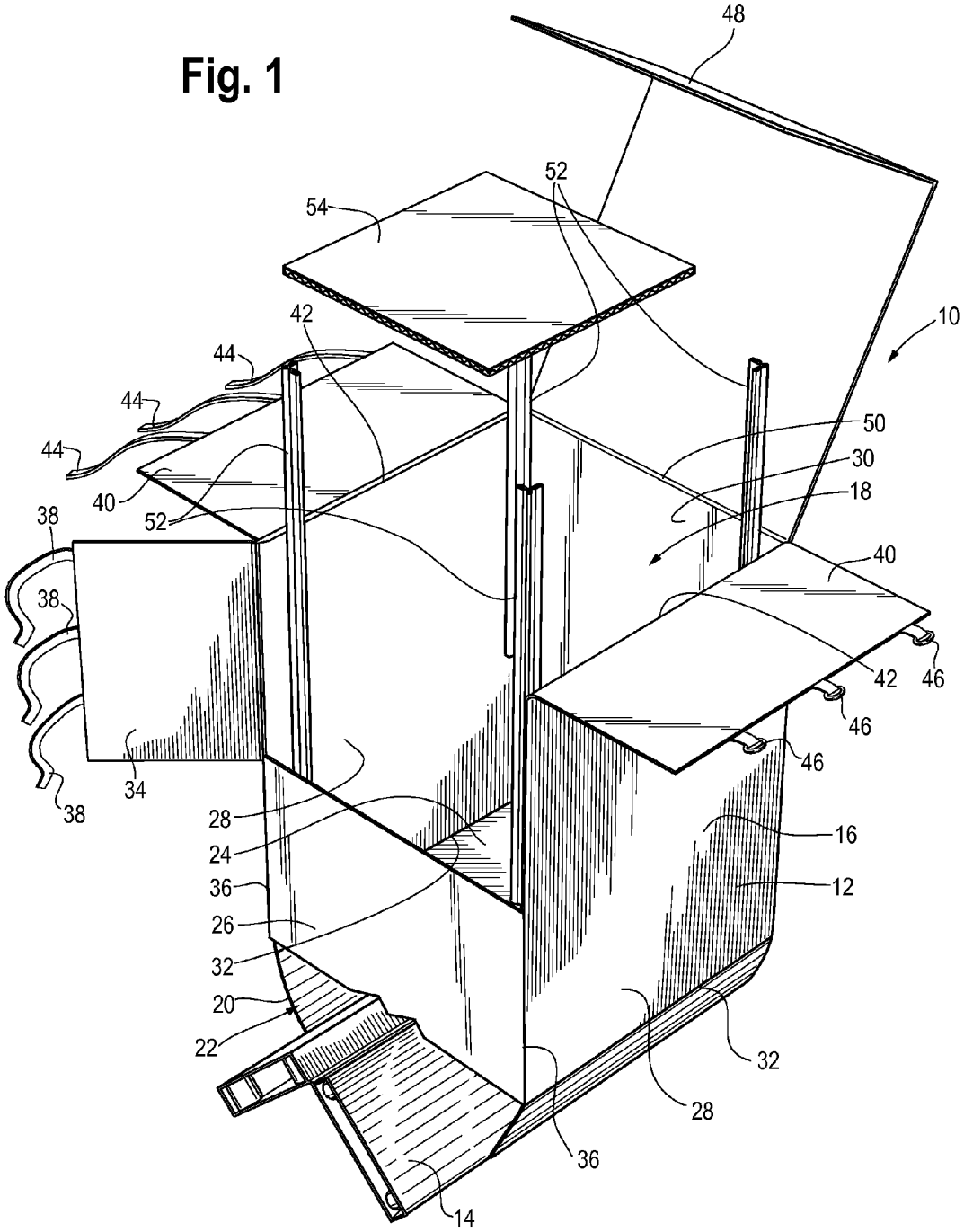

FIGS. 8*a*, 8*b*, 8*c* and 8*d* are perspective views of four pallets that may be used with the present invention.

DETAILED DESCRIPTION OF THE INVENTION

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Soft Goods Carrier

Turning to the drawings, there is shown in FIG. 1 one embodiment of the present invention, a bulk bag carrier for transporting soft goods. The carrier 10 comprises a bulk bag 12 and a pallet 14. The bulk bag 12 comprises an upper section 16 that defines a product compartment 18 for holding the soft goods and a lower section or sleeve 20 that defines a built in pocket 22 for receiving the pallet 14. The bulk bag 12 serves as a flexible structure for holding the contents of the carrier 10 and may be made of woven polypropylene or any suitable material.

Despite being flexible, the upper section 16 is generally rectilinear in shape when filled, and comprises a bottom wall 24, a front wall 26, two opposing side walls 28 and a rear wall 30. The front, side and rear walls 26, 28, 30 extend upwardly from the periphery of the bottom wall 24 and define interior vertical corners. The front wall 26 may include one or more front flaps 34 hingedly connected to the top rim 42 of each side wall 28. The one or more front flaps 34 may open outwardly to facilitate loading and unloading. The front flaps 34 may include straps 38 or other securing means to enable the front flaps 34 to be tied together or to another flap or structure when closing the upper section 16.

A side flap 40 may be hingedly connected to the top rim 42 of each opposing side wall 28 and can be folded over toward each other to cover the carrier's contents. The side flaps 40 may also include straps 44 and/or loops 46 to enable the side flaps 40 to be tied together or to another flap or structure.

In similar fashion, a rear flap 48 may be hingedly connected to the top rim 50 of the rear wall 30 and can be folded over to cover the carrier's contents. The rear flap 48 can be tied or otherwise secured to another flap or structure to completely enclose and protect the carrier contents.

The carrier 10 may be opened at both the top and the front to allow better access to the interior or product compartment 18. For example, the rear flap 48 can be untied or otherwise released from the other flaps or structures and pulled back. The side flaps 40 can be untied or otherwise released from the other flaps or structures and pulled back. The front flap 34 can be untied or otherwise released from the other flaps or structures and pulled out, allowing ample access to the top and front of the carrier 10 for loading.

Rigid structures such as corner posts 52 may be inserted along the interior vertical corners to "square up" and support the flexible bulk bag 12, help stabilize the contents and increase stacking strength. The corner posts 52 may be wound paper corner posts of the kind manufactured by Sonoco Products Company of Hartsville, S.C. and marketed under the trademark SONOPOST®.

A top reinforcement panel 54 may be placed on top of the contents and/or the corner posts 52 before the side flaps 40 and rear flap 48 are folded over. The top reinforcement panel 54 increases stacking stability which is especially useful in storing and transporting flexible goods. The top reinforcement panel 54 may be honeycomb, corrugated or any suitable rigid or semi-rigid material. After loading of the soft goods and while closing the bulk bag 12, the top reinforcement panel 54 may be pressed down to save space and help form a stable unit.

Figure 2A:
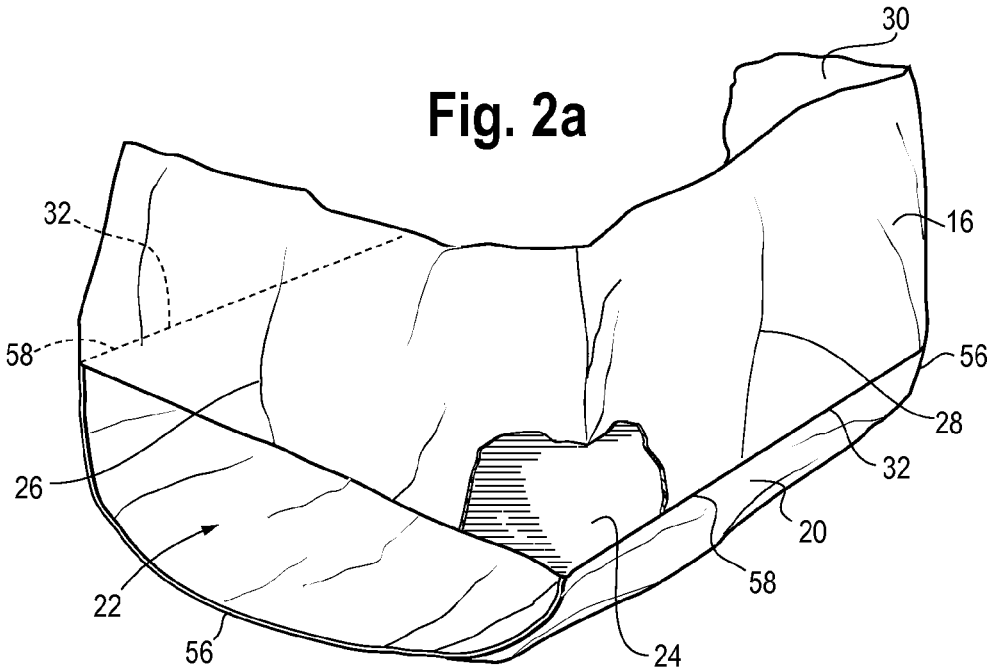

FIG. 2*a* is a close up perspective view of a portion of the bulk bag carrier of FIG. 1 showing the sleeve 20 in more detail. The sleeve 20 comprises a substantially rectangular section of flexible material depending downward from (i.e., suspended from) the upper section 16 of the bulk bag 12. The sleeve 20 has front and rear edges 56 and side edges 58. The front and rear edges 56 may be free, that is, not attached to anything. Each side edge 58 is substantially coextensive with and attached to a side edge 32 of the bottom wall 24. Thus, one side edge 58 of the sleeve 20 is attached to a first side edge 32 of the bottom wall 24, and the other side edge 58 of the sleeve 20 is attached to a second side edge 32 of the bottom wall 24 opposite the first side edge 32.

The length of the sleeve side edges 58 is substantially equal to the depth of the carrier 10 which may be substantially the same as the depth of the pallet 14. The length of the sleeve front and rear edges 56, i.e., the distance between side edges 58 if the sleeve 20 were laid flat, is sufficiently greater than the width of the carrier 10, and thus the width of the pallet 14, to allow a pallet 14 to be inserted into the pocket 22.

Figure 2B:
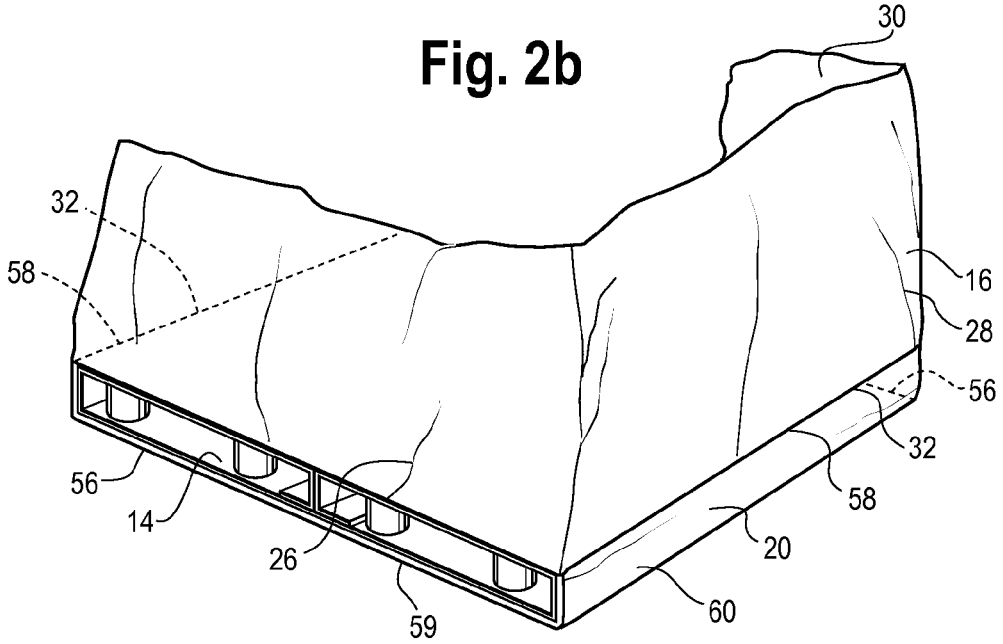

This is shown more clearly in FIG. 2*b*, which shows the portion of the bulk bag carrier of FIG. 2*a* after a pallet 14 has been inserted into the sleeve 20. When the pallet 14 is inserted into the sleeve 20 the sleeve 20 assumes a substantially rectilinear shape (like that of the pallet 14) having a substantially flat bottom 59 and side walls 60. Here it can readily be seen that the overall length of the sleeve front and rear edges 56 (as measured from one side edge 58 to the other side edge 58) is substantially the same as or just slightly greater than the width of the pallet 14 plus twice the height of the pallet 14. It will be appreciated that a sleeve 20 with such dimensions creates a pocket 22 in which the pallet 14 fits snugly.

The carrier 10 with corner posts 52 and integral pallet 14 is a surprisingly stable unit, one that resists leaning while being lifted and moved with a fork lift truck, even when the contents of the carrier 10 are not perfectly balanced. The carrier 10 is also much more suitable for stacking than previous bulk bag carriers.

Foldable Pallet

Figure 3A:
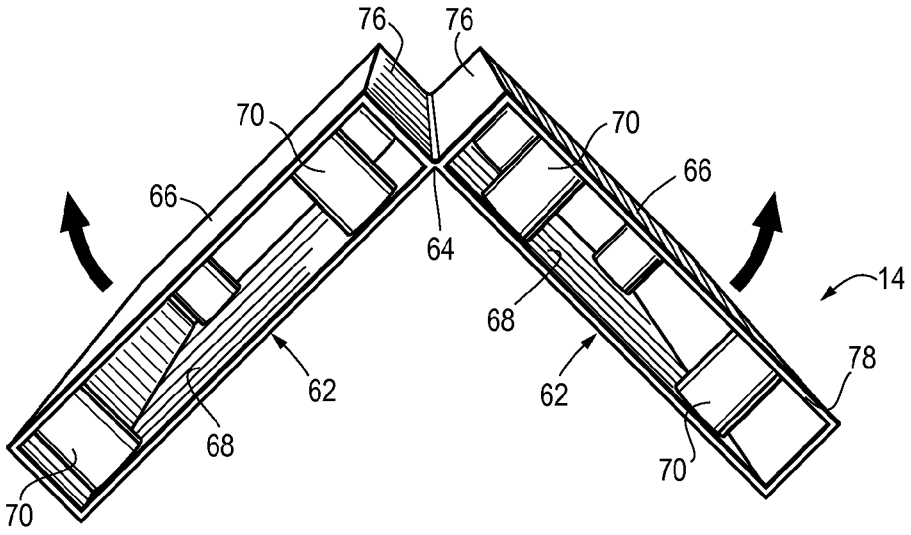
Figure 3B:
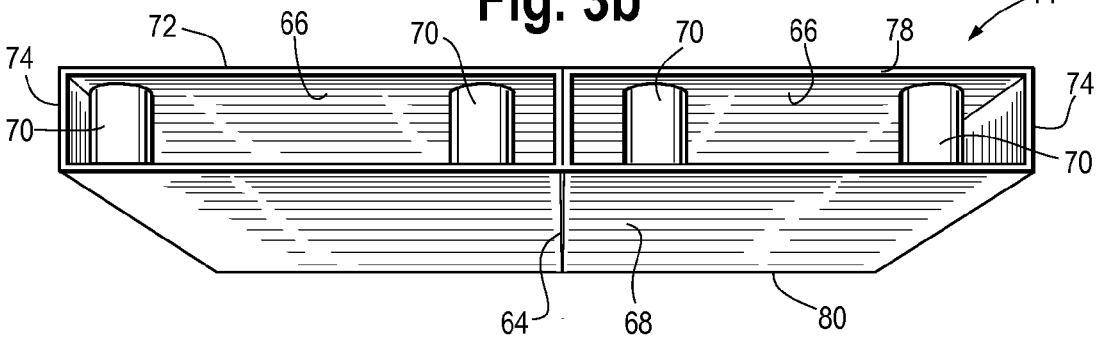

To further facilitate fitting the pallet 14 into the pocket 22, the pallet 14 may be foldable. FIGS. 3*a* and 3*b* are close up views of the foldable pallet 14 of FIG. 1. The pallet 14 has a bi-fold design and comprises two substantially equal halves 62 connected along a hinge 64. Each half 62 comprises a top sheet 66 and a bottom sheet 68 separated by spacers 70. The spacers 70 may be hollow cylindrical paper cores or any suitable type of spacer. Each half 62 may further comprise a vertically oriented outer wall 74 connecting the top sheet 66 and the bottom sheet 68 of each respective half 62 along the sides of the pallet 14. Each half 62 may further comprise a vertically oriented inner wall 76 extending upwardly from the hinge 64 and connecting the top sheet 66 and the bottom sheet 68 of each respective pallet half 62.

Together the two top sheets 66 form a top, load bearing surface 72 as shown in FIG. 3*b*. The bottom sheet 68 may be one continuous sheet having a hinge 64 in the middle of the bottom sheet 68 running from the front edge 78 of the pallet 14 to the rear edge 80 of the pallet 14.

Method of Assembly

Assembling the carrier 10 requires inserting the pallet 14 into the pocket 22 defined by the sleeve 20. To insert the foldable pallet 14 into the pocket 22, the user folds the pallet 14 into approximately a 45 degree or V-shape as shown in FIG. 3*a*, slides it into the pocket 22 and pushes down on it so that it assumes the unfolded or flat configuration shown in FIG. 3*b*, which locks the pallet 14 securely within the pocket 22. Pushing down on the pallet 14 while it is in the pocket 22 increases its lateral circumference (e.g., the sum of the lateral dimensions of the pallet top surface 72 and the bottom sheet 68 and the vertical dimensions of the outer walls 74) and snugs up the sleeve 20 against the pallet 14 so that the pallet 14 occupies essentially all the space within the sleeve 20.

Figure 4A:
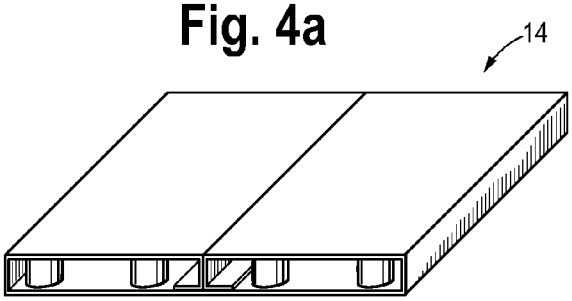
Figure 4B:
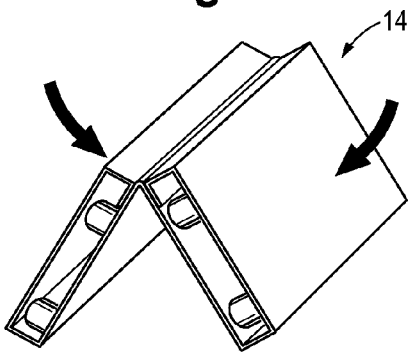
Figure 4C:
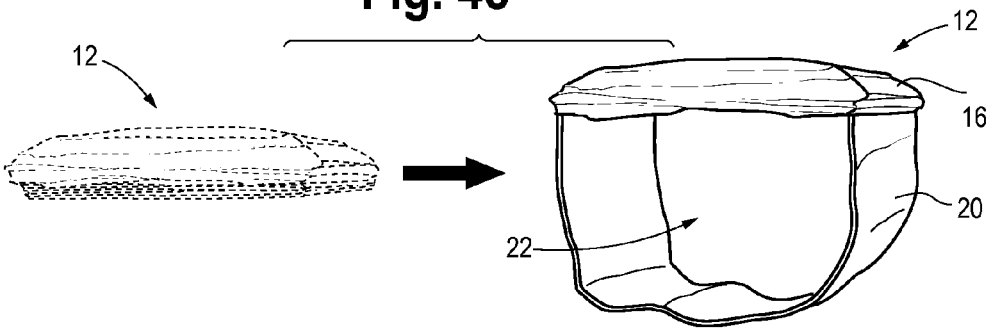
Figure 4D:
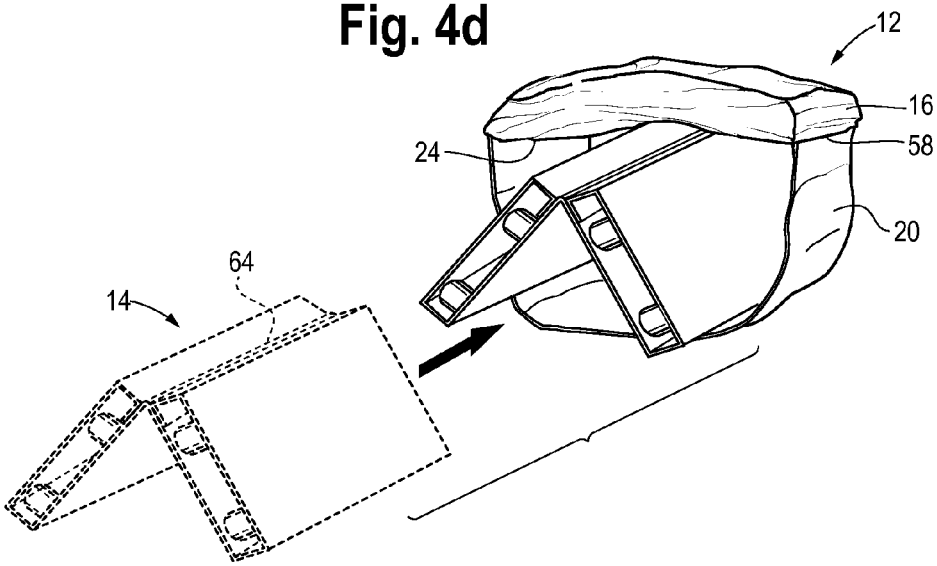
Figure 4E:
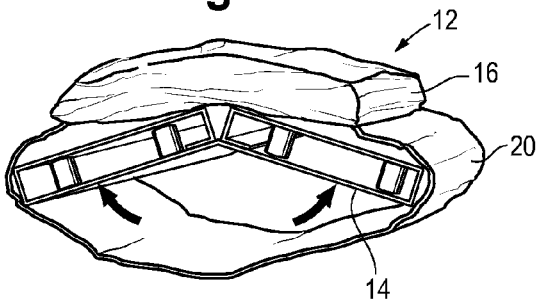
Figure 4F:
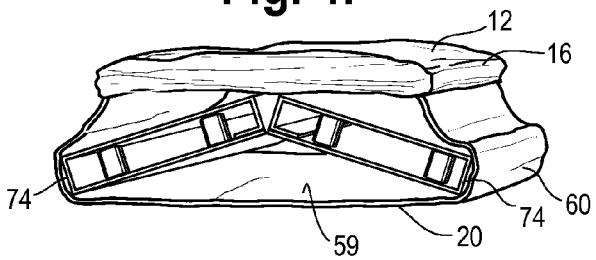

FIGS. 4*a* to 4*h* show the steps involved in assembling a carrier 10 like that shown in FIG. 1. To assemble the carrier 10, a foldable pallet 14 like that shown in FIG. 4*a* is provided. The user folds the pallet 14 into roughly a 45 degree shape as shown in FIG. 4*b*. The user then takes a bulk bag 12 and opens the sleeve 20 to expose the pocket 22 (FIG. 4*c*) and slides the folded pallet 14 into the pocket 22 (FIG. 4*d*) with the pallet hinge 64 substantially parallel to the side edges 58 of the sleeve 20 and with the open end of the "V' preferably facing downward, away from the upper section bottom wall 24.

Figure 4G:
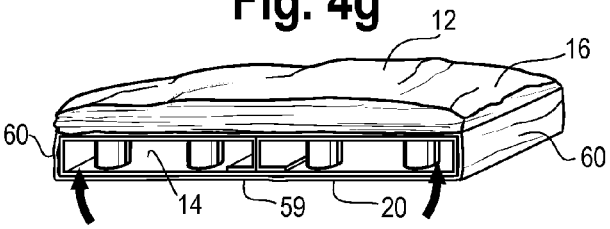
Figure 4H:
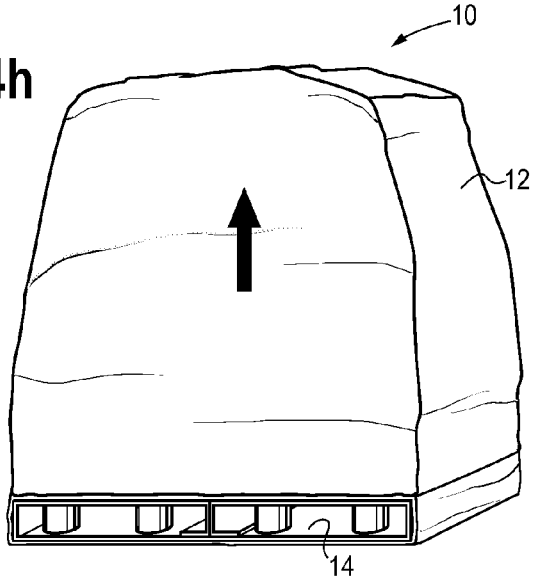

Next, the user starts unfolding the pallet 14 (FIG. 4*e*), positions the pallet 14 so that the pallet outer walls 74 are substantially adjacent the flexible side walls 60 of the sleeve 20 (FIG. 4*f*), then pushes down on the pallet 14 until it is flat and held snugly within the sleeve 20 (FIG. 4*g*). The bulk bag 12 and integral pallet 14 are now ready to use (FIG. 4*h*). FIG. 4*h* shows how flexible the bulk bag 12 material is, especially before the corner posts 52 have been inserted into the upper section 16 of the bulk bag 12 and before any product has been loaded.

Granular Goods Carrier

Figure 5:
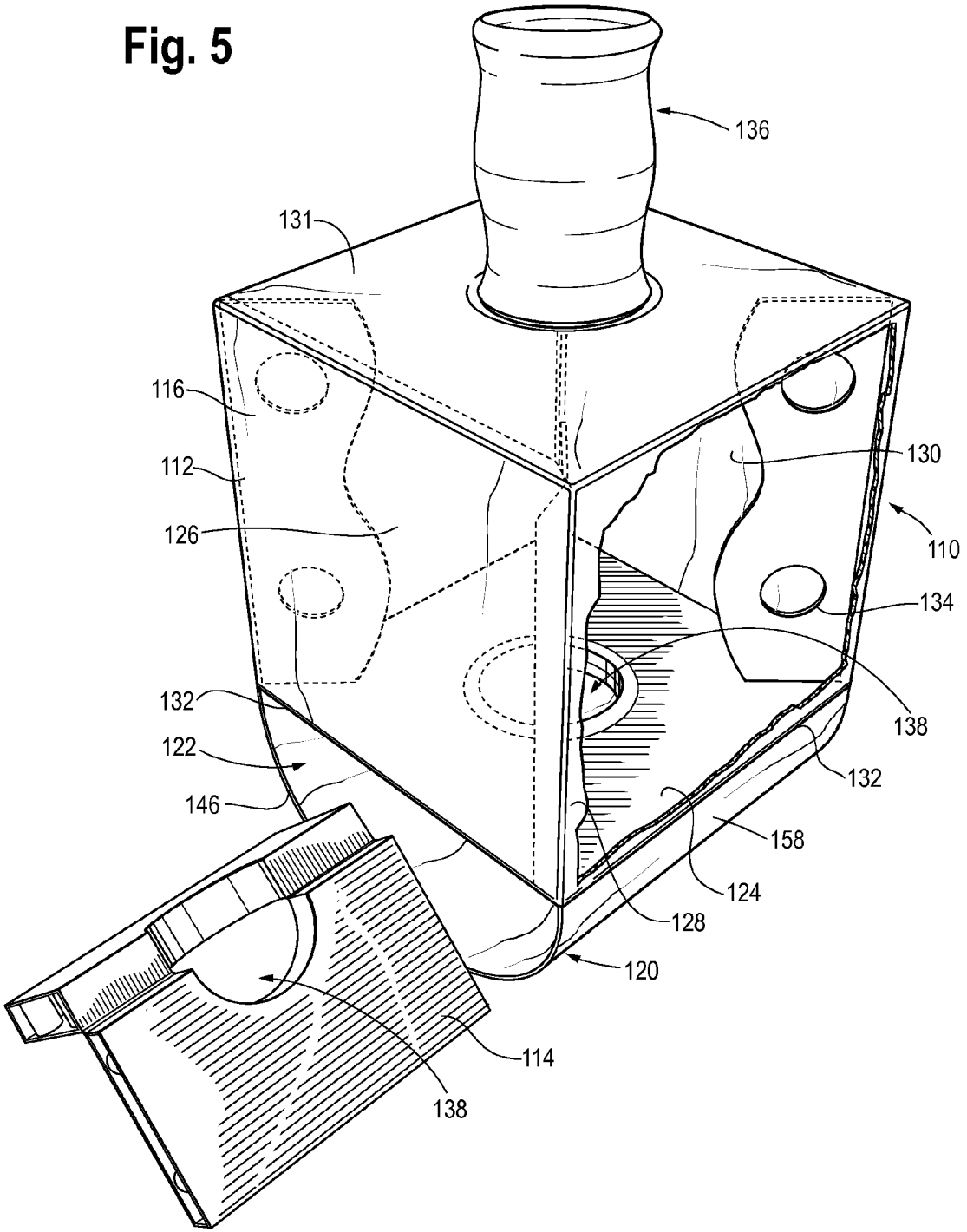
FIG. 5 is an exploded perspective view of a second embodiment of a bulk bag carrier.

FIG. 5 is an exploded cutaway perspective view of a second embodiment of a bulk bag carrier 110 for use in transporting powders, granular items and the like. The carrier 110 is very similar to the previous embodiment carrier 10, and like that embodiment comprises a bulk bag 112 and a pallet 114, where the bulk bag 112 comprises an upper section 116 that defines a product compartment 118 for holding the product and a sleeve 120 that defines a built in pocket 122 for receiving the pallet 114.

The flexible upper section 116 can take on a generally rectilinear shape and comprises a bottom wall 124, an upwardly extending front wall 126, upwardly extending side walls 128, an upwardly extending rear wall 130 and a top wall 131. The front, side and rear walls 126, 128, 130 extend upward from the periphery 132 of the bottom wall 124 and may include baffles 134.

A fill chute 136 may extend upward from an opening in the top wall 131 to facilitate pouring or otherwise loading product into the product compartment 118 of the carrier 110. The fill chute 136 can be tied closed and tied down.

As in the previous embodiment, the sleeve 120 comprises a substantially rectangular section of flexible material depending downward from the upper section 116 of the bulk bag 112. The sleeve 120 has front end rear edges 146 of substantially equal dimensions and two side edges 148 of substantially equal dimensions. The length of each sleeve side edge 148 is substantially equal to the depth of the carrier 110 which is substantially the same as the depth of the pallet 114. The length of the front and rear edges 146, i.e., the distance between side edges 148 if the sleeve 120 were laid flat, is sufficiently greater than the width of the carrier 10, and thus the width of the pallet 114, to allow a pallet 114 to be inserted into the pocket 122. Put another way, the length of the sleeve front and rear edges 146 is just slightly greater than the width of the pallet 114 plus twice the height of the pallet 114. It will be appreciated that a sleeve 120 with such dimensions creates a pocket 122 in which the pallet 114 fits snugly.

Still referring to FIG. 5, the bulk bag 112 and the pallet 114 may have an integral dispensing feature that allows the contents of the bulk bag to be dispensed though the bottom of the bulk bag 112. For example, the bottom wall 124 may define an opening 138 that is aligned with a similarly shaped and sized opening 140 in the pallet 114 to allow product to be dispensed out the bottom of the carrier 110.

Figure 6:
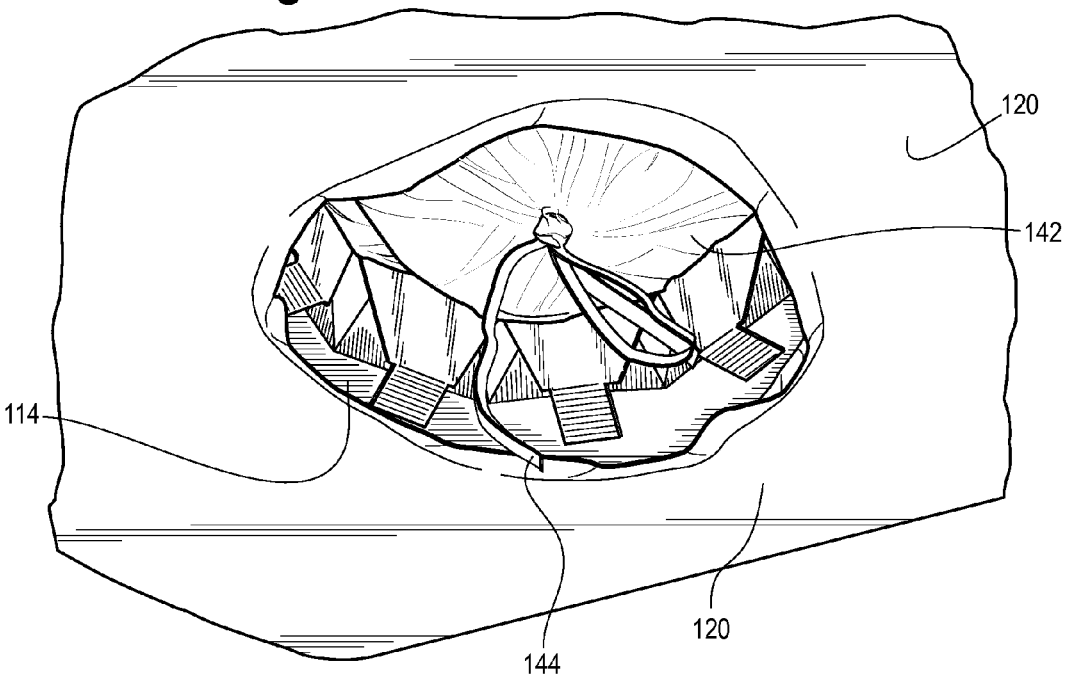
FIG. 6 is a close up perspective view of the underside of the carrier of FIG. 5, showing the bottom chute in the closed position.

As perhaps best shown in FIG. 6 a tied bottom chute 142 may cover the opening 140 in the pallet 114. The bottom chute 142 may be an integral part of the bulk bag 112 and as such may be made of the same flexible but strong material. The bottom chute 142 may include ties 144 or other securing means so that the bottom chute 142 can be closed to form part of the load bearing surface of the bottom wall 124 without hanging down below the pallet 114. The chute material is strong enough to bridge the opening 140 in the pallet 114 and support the carrier contents.

Figure 7:
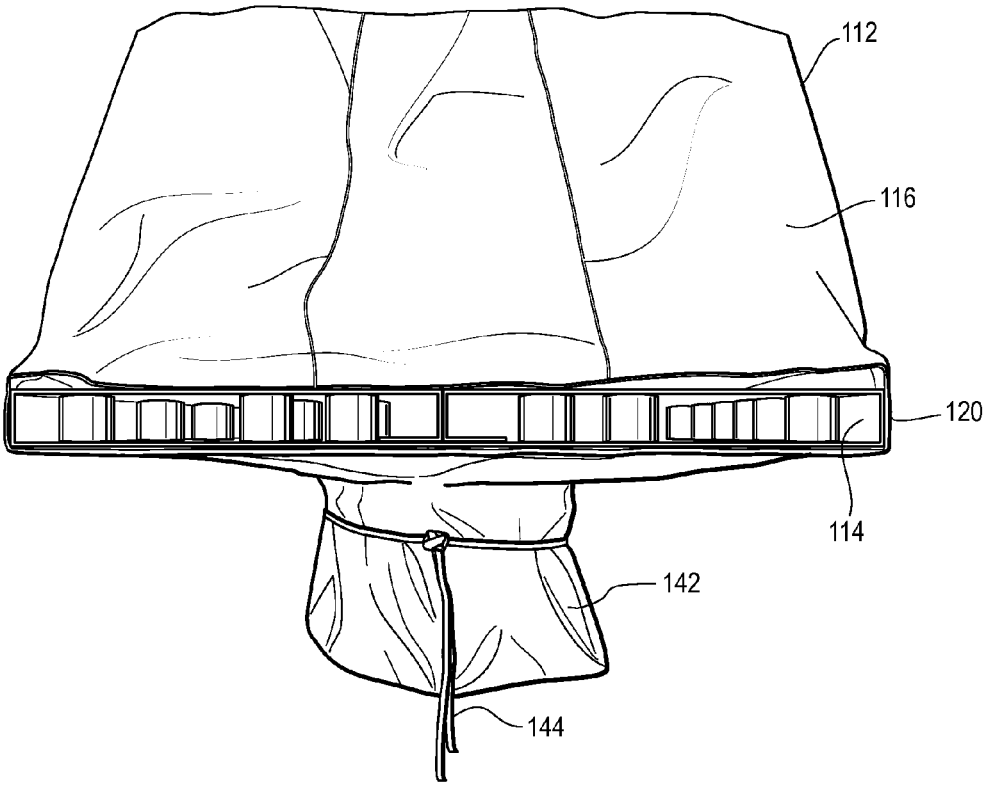
FIG. 7 is a close up front view of the carrier of FIG. 5, showing the bottom chute in the open position.

FIG. 7 is a close up side view of the carrier 110 of FIG. 5, showing the bottom chute 142 in the open position. As shown in FIG. 7 the bottom chute 142 may be cylindrical when untied and may extend below the pallet 114 for easy product dispensing.

The carrier 110 exhibits better stackability than conventional bulk bag type carriers. In addition to the stacking strength provided by the carrier 110 itself, the granular product inside the bulk bag 112 will tend to distribute evenly in the bag 112 and thus further stabilize the unit.

Pallets

It should be understood that the pallet used with the carriers described herein can be made in various versions depending on the user's requirements. For example and without limitation, FIGS. 8*a* 8*b*, 8*c* and 8*d* show four types of pallets that may be used with the carriers.

Figure 8A:
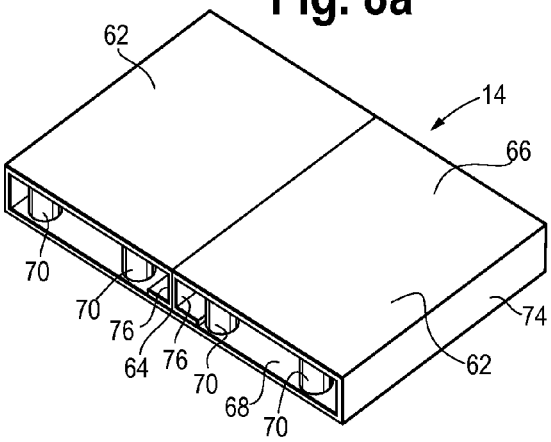

FIG. 8*a* is a perspective view of the pallet 14 previously shown in FIGS. 1, 2*b*, 3*a*, 3*b* and 4*a*-4*h*. As explained above, the pallet 14 has a bi-fold design and comprises two halves 62 connected along a hinge 64 for ease of insertion into the bulk bag sleeve 20.

Figure 8B:
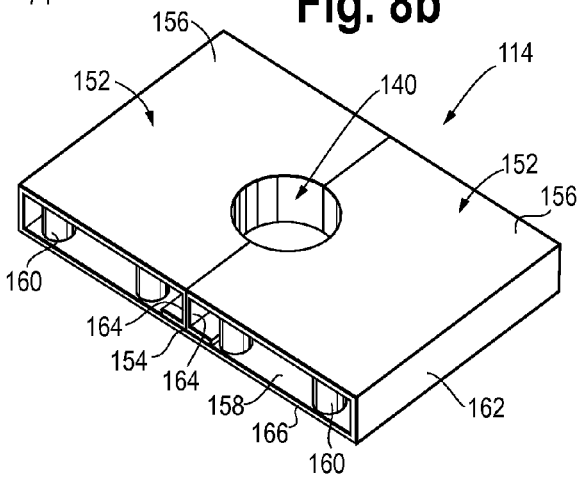

FIG. 8*b* is a perspective view of the bi-fold pallet 114 shown in FIGS. 5-7. The pallet 114 is similar to the pallet of FIG. 8*a* but has a central opening 140 to facilitate dispensing granular products out the bottom of a carrier. The pallet 114 comprises two substantially equal halves 152 connected along a hinge 154. Each half 152 comprises a top sheet 156 and a bottom sheet 158 separated by spacers 160. The spacers 160 may be hollow cylindrical paper cores or any suitable type of spacer. Each half 152 may further comprise a vertically oriented outer wall 162 connecting the top sheet 156 and the bottom sheet 158 of each respective half 152 along the sides of the pallet 114. Each half 152 may further comprise a vertically oriented inner wall 164 extending upwardly from the hinge 154 and connecting the top sheet 156 and the bottom sheet 158 of each respective pallet half 152. Together the two top sheets 156 form a top, load bearing surface. The bottom sheet 158 may be one continuous sheet having a hinge 154 in the middle of the bottom sheet 158 running from the front edge 166 of the pallet 114 to the rear edge of the pallet 114.

Figure 8C:
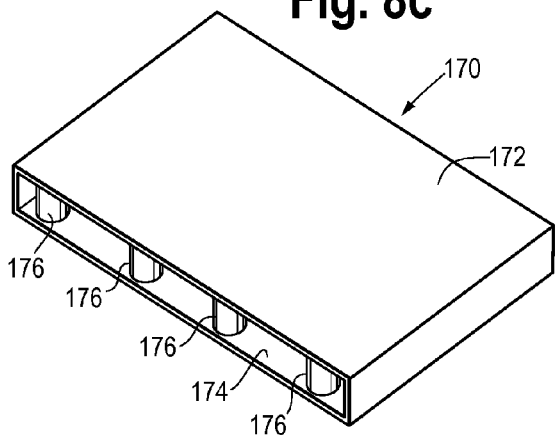

FIG. 8*c* is a perspective view of a non-foldable pallet 170. The pallet 170 comprises a top sheet 172 and a bottom sheet 174 separated by hollow cylindrical spacers 176.

Figure 8D:
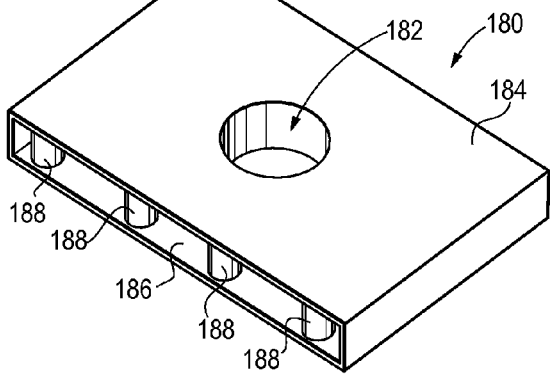

FIG. 8*d* is a perspective view of a non-foldable pallet 180 with a central dispensing opening 182. The pallet 180 is similar to that of FIG. 8*c* but has a central dispensing opening 182 located in both the top sheet 184 and the bottom sheet 186. Spacers 188 separate and support the top and bottom sheets The bi-fold pallets 14, 114 of FIGS. 8*a* and 8*b* generally are easier to insert into the carrier sleeve as explained above. The pallets 114, 180 with the central openings of FIGS. 8*b* and 8*d* are best suited for use with granular products that can be dispensed through the bottom of the carrier.

Industrial Applicability

The carriers of the present invention may be used to hold and ship various soft goods and powered or granular goods. For example, the carrier 10 of FIG. 1 is particularly suitable for shipping goods such as seat covers for automobiles or any other suitable type of soft goods. The carrier 110 of FIG. 5 is particularly suitable for holding, shipping and dispensing powdered or granular goods and other bulk products, including but not limited to coffee and plastic pellets.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A carrier comprising a flexible bulk bag, the bulk bag comprising:

an upper section that defines a product compartment for holding products, the upper section comprising a bottom wall having first and second opposing side edges which form part of a periphery, the upper section further comprising a front wall, two opposing side walls and a rear wall, the front, side and rear walls extending upwardly from the periphery of the bottom wall;

a sleeve that defines a built in pocket for receiving a pallet, the sleeve comprising a substantially rectangular section of flexible material depending downward from the upper section, the sleeve having a free front edge, a free rear edge and two side edges, one side edge of the sleeve being substantially coextensive with and attached to the first side edge of the bottom wall and the other side edge of the sleeve being substantially coextensive with and attached to the second side edge of the bottom wall; and a pallet; wherein the front and rear edges of the sleeve are of approximately equal length; and wherein the pallet fits snugly within the sleeve.

2. The carrier of claim 1:

wherein the pallet has a width and a height; and wherein the length of the sleeve front and rear edges is slightly greater than the width of the pallet plus twice the height of the pallet.

3. The carrier of claim 1 wherein the pallet is foldable.

4. The carrier of claim 3 wherein the pallet comprises:

two substantially equal halves foldably connected along a hinge.

5. The carrier of claim 4 wherein the each pallet half comprises:

a top sheet and a bottom sheet separated by spacers.

6. The carrier of claim 5 wherein each pallet half further comprises:

a vertically oriented outer wall connecting the top sheet and the bottom sheet; and a vertically oriented inner wall extending upwardly from the hinge and connecting the top sheet and the bottom sheet.

7. The carrier of claim 1 wherein the front, side and rear walls define four interior vertical corners, the carrier further comprising:

a corner post located along each interior vertical corner.

8. The carrier of claim 7 further comprising:

a flat reinforcement panel disposed on top of the corner posts.

9. A method of assembling a carrier, the method comprising the steps of:

providing a carrier having an upper section that defines a product compartment and a sleeve that defines a built in pocket for receiving a pallet;

folding a foldable pallet into a V-shape;

sliding the V-shaped pallet into the pocket; and pushing down on the V-shaped pallet so that it assumes a flat configuration occupying essentially all the space within the sleeve.

10. A carrier for granular products, the carrier comprising:

an upper section that defines a product compartment for holding granular products, the upper section comprising a bottom wall having first and second opposing side edges which form part of a periphery, a front wall, two opposing side walls and a rear wall, the front, side and rear walls extending upwardly from the periphery of the bottom wall; and a sleeve that defines a built in pocket for receiving a pallet, the sleeve comprising a substantially rectangular section of flexible material depending downward from the upper section, the sleeve having a free front edge, a free rear edge, and two side edges, one side edge of the sleeve being substantially coextensive with and attached to the first side edge of the bottom wall and the other side edge of the sleeve being substantially coextensive with and attached to the second side edge of the bottom wall, the bottom wall defining an opening: and a pallet having a vertical opening there through;

wherein the bottom wall opening is vertically aligned with and similar in size and shape to the pallet opening.

11. The carrier of claim 10, further comprising a bottom chute covering the opening in the pallet and being an integral part of the bulk bag.

12. The carrier of claim 10:

wherein the pallet has a width and a height; and wherein the length of the front and rear edges of the sleeve is just slightly greater than the width of the pallet plus twice the height of the pallet.

13. The carrier of claim 10 wherein the pallet can be folded.

14. The carrier of claim 13 wherein the pallet comprises:

two substantially equal halves connected along a hinge, each half comprising a top sheet and a bottom sheet separated by spacers, a vertically oriented outer wall connecting the top sheet and the bottom sheet, and a vertically oriented inner wall extending upwardly from the hinge and connecting the top sheet and the bottom sheet.

15. A carrier comprising a flexible bulk bag, the bulk bag comprising:

an upper section that defines a product compartment for holding products, the upper section comprising a bottom wall having first and second opposing side edges which form part of a periphery, the upper section further comprising a front wall, two opposing side walls and a rear wall, the front, side and rear walls extending upwardly from the periphery of the bottom wall;

a sleeve that defines a built in pocket for receiving a pallet, the sleeve comprising a substantially rectangular section of flexible material depending downward from the upper section, the sleeve having a free front edge, a free rear edge and two side edges, one side edge of the sleeve being substantially coextensive with and attached to the first side edge of the bottom wall and the other side edge of the sleeve being substantially coextensive with and attached to the second side edge of the bottom wall; and a single, unitary pallet disposed within the sleeve, the pallet comprising a top sheet, a bottom sheet and two vertically oriented outer walls extending between the top sheet and the bottom sheet to form a structure having a rectangular profile, wherein the sleeve fits snugly against the top sheet, the bottom sheet and the two outer walls.

16. The carrier of claim 15 wherein the pallet is foldable.

* * * * *